US005101722A

United States Patent [19]

Nagatani

[11] Patent Number: 5,101,722

[45] Date of Patent: Apr. 7, 1992

[54] CYLINDER TYPE SILK-SCREEN PRINTING APPARATUS

[75] Inventor: Kazuo Nagatani, Seki, Japan

[73] Assignee: Sakura Seiki Co., Ltd., Mino, Japan

[21] Appl. No.: 618,458

[22] Filed: Nov. 27, 1990

[30] Foreign Application Priority Data

Jun. 26, 1990 [JP] Japan ..... 2-169218

[51] Int. Cl.[5] ..... B41F 15/22

[52] U.S. Cl. ..... 101/124; 101/126

[58] Field of Search ..... 101/123, 124, 126, 282, 101/416.1, 425

[56] References Cited

U.S. PATENT DOCUMENTS

| | | | |
|---|---|---|---|
| 2,209,688 | 7/1940 | Davis | 101/124 |
| 2,968,239 | 1/1961 | Zumbehl | 101/126 |
| 3,260,194 | 7/1966 | Karlyn | 101/124 |
| 3,941,053 | 3/1976 | Black et al. | 101/124 |
| 4,121,519 | 10/1978 | Porth | 101/124 |
| 4,376,412 | 3/1983 | Nagatani | 101/124 |
| 4,448,124 | 5/1984 | Nagatini | 101/124 |
| 4,509,422 | 4/1985 | Nagatani | 101/124 |

FOREIGN PATENT DOCUMENTS

| | | | |
|---|---|---|---|
| 2016377 | 8/1982 | Fed. Rep. of Germany | 101/124 |
| 866259 | 4/1961 | United Kingdom . | |

OTHER PUBLICATIONS

Patent Abstracts of Japan, vol. 13, No. 154 (M-814) (3502) Aug. 14, 1989 & JP-A-A-63 315 240 (Minoguruupu K. K.) Dec. 22, 1988.

*Primary Examiner*—Edgar S. Burr
*Assistant Examiner*—Stephen R. Funk
*Attorney, Agent, or Firm*—Oblon, Spivak, McClelland, Maier & Neustadt

[57] ABSTRACT

During printing operations, the rack of a print frame and the rack of an operation piece attached to the bottom face of the print frame are continuous. These racks are engaged by gears attached to a print cylinder. The print frame is moved in synchronization with rotations of the cylinder. When printing is stopped, a camming arrangement raises the operation piece to release the operation piece from the gears so that the print frame can be pulled from the machine base independently from the cylinder.

21 Claims, 6 Drawing Sheets

CYLINDER TYPE SILK-SCREEN PRINTING APPARATUS

BACKGROUND OF THE INVENTION

1. Field of the Invention

This invention relates to a cylinder type silk-screen printing apparatus, and more particularly to an apparatus capable of moving a print frame independently from its cylinder.

2. Description of the Related Art

In cylinder type silk-screen printing devices, ink sticks on the silk-screen and the cylinder after repetitive printing operations. This sticking of the ink will degrade the quality of printing work. Because of this, it is necessary to frequently and properly wipe ink from the silk-screen and cylinder and to keep them clean.

A cleaning method for the purpose stated above, is disclosed in U.S. Pat. No. 4,448,124. According to this disclosed printing machine, a paper ejecting base 101 is installed in a swingable manner as shown in FIG. 6 of the present application. During printing operations, the paper ejecting base 101 is held in a horizontal orientation as indicated by the two-dot chain. Thus, it feeds printing paper P sent by the rotation of cylinder 100 to a recovering device (not shown in the drawings).

To clean the inside of the machine, the paper ejecting base 101 is swung in the direction indicated by the arrow in FIG. 6 to the suspended position indicated by solid lines. This opens the space below the print frame 102. Thus an operator can lean into the printing machine to wipe ink from the bottom face of silk-screen 103 and the periphery of the cylinder 100.

Since the print frame 102 is located at the rear of the cylinder 100 within the machine, the operator has to lean the upper portion of his body into the machine in order to wipe ink from the entire cylinder and silk-screen. However, fitting into the limited space in the machine is difficult, especially for a tall man.

Therefore, when a large operator tries to wipe ink from the inner parts, ink sometimes remains partially unremoved. The remaining ink sticks firmly on the rear face of silk-screen 103, thereby obstructing good printing operation thereafter.

SUMMARY OF THE INVENTION

Therefore, a primary object of this invention is to provide a silk-screen printing apparatus that is capable of assuring reliable cleaning of the cylinder regardless of the size of the operator. Another object of this invention is to provide a cylinder type silk-screen printing apparatus having a print frame that can be easily pulled from the machine base to provide a wide space inside the machine base.

According to one of the preferred embodiments of the invention, a cylinder type silk-screen printing apparatus that performs a printing operation by moving a silk-screen print in synchronization with the rotation of a cylinder located inside a machine base is provided. The printing apparatus includes a print frame located above the cylinder for carrying the silk-screen print. The print screen is linked with the cylinder during printing and reciprocates in the horizontal direction in synchronization with the rotation of the cylinder.

A releasing mechanism is operable during non-printing times to release the linkage between the print frame and the cylinder to permit movement of the print frame indepenent from the rotation of said cylinder.

According to the second preferred embodiment of the invention, an ink-receiving tray is provided at the upper portion of a machine base between a squeegee and the silk-screen print. The tray is moved in synchronization with the releasing mechanism between a first position that faces the cylinder and a second position separated to the side of the cylinder.

In a preferred embodiment of the invention, a paper ejecting base is installed on the machine base in a swingable manner between a horizontal position and a suspended position.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments together with the accompanying drawings in which:

DETAILED DESCRIPTION OF THE PREFERRED EMBODIMENT

Figure 1:
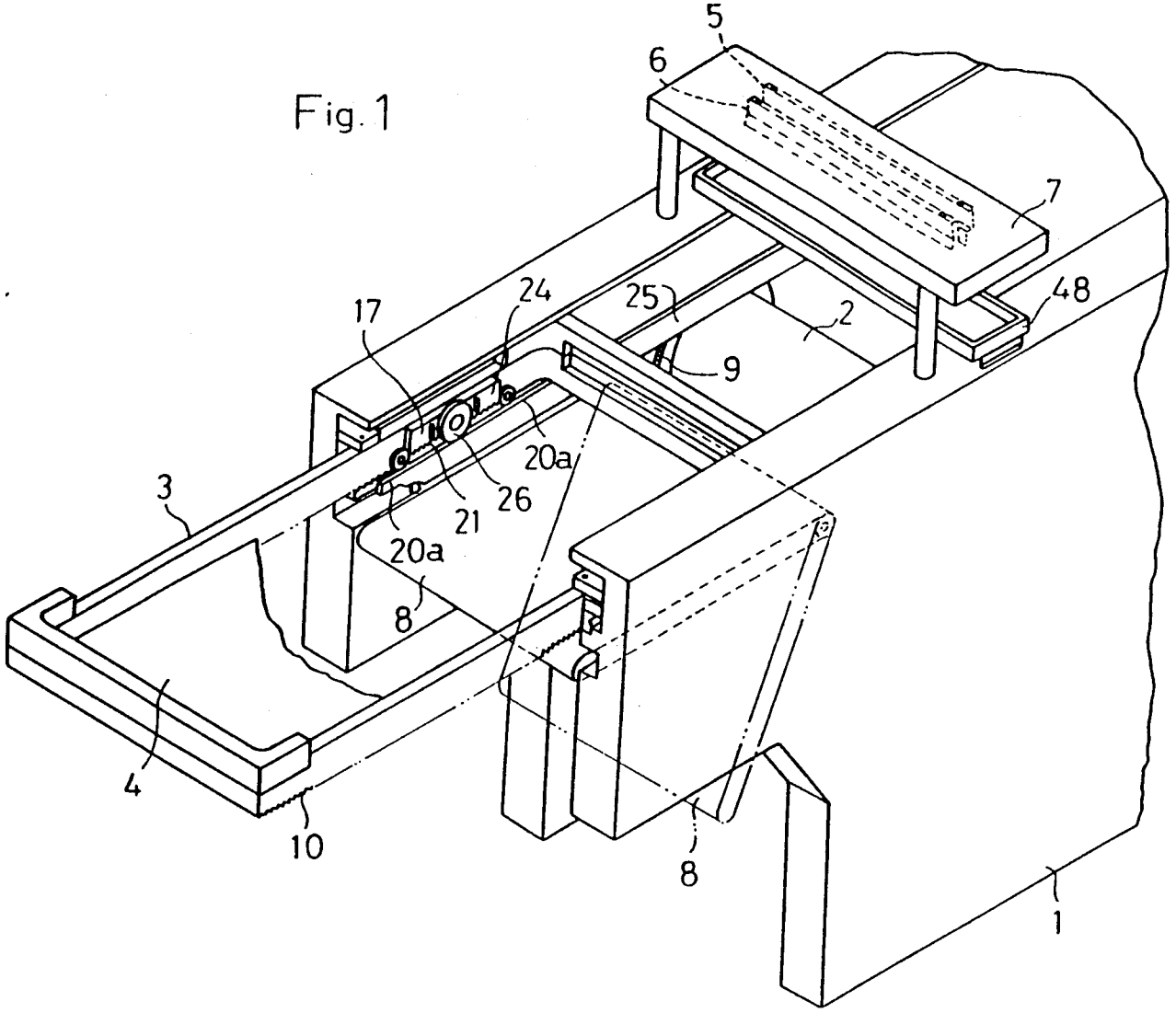
FIG. 1 is an isometric view showing the silk-screen printing apparatus of the invention when the print frame is pulled to the outside of the machine base in a non-printing state.
Figure 2:
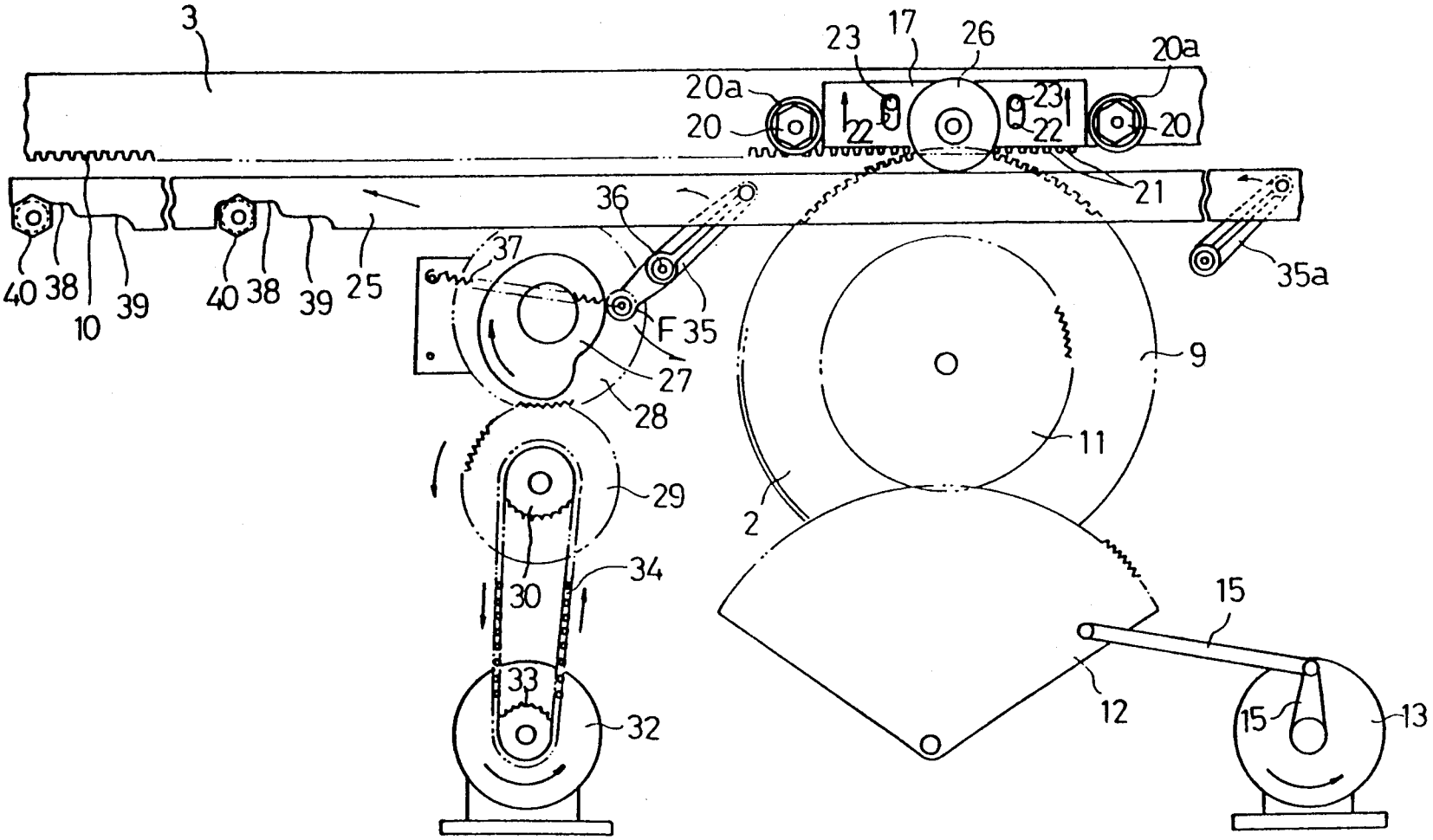
FIG. 2 is a side view showing each operating mechanism of the silkscreen printing apparatus during a printing operation.

As shown in FIG. 1 and FIG. 2, a cylinder 2 is supported in a rotatable manner at the center in a machine base 1. As indicated in FIG. 1, a horizontally extending rail 25 is mounted to the inner wall surface of the machine base 1 above the cylinder 2. A print frame 3 having a rectangular loop shape is located above the rail 25. A silk-screen 4 is located inside the loop of the print frame. A squeegee 6 and a doctor 5 are mounted on a mounting plate 7, which is fixed to the machine base 1 above the cylinder 2. The silk-screen 4 is located between the cylinder and the mounting plate.

A paper ejecting plate 8 is provided at a paper ejecting side (at the left side in the figure) of the machine base 1 and can be swung between the horizontal position shown by the solid line in FIG. 1 and the suspended position shown by the two-dot chain line. During printing operation, the paper ejecting plate 8 is in horizontal position. In this position, it feeds printing paper to a recovering device (not shown). During non-printing times, it is swung to the suspended position thereby widening the space at the paper ejecting side of the machine base 1.

Drive gears 9 are fixed to opposing ends of said cylinder 2. The drive gears 9 have a diameter larger than that of the cylinder. These drive gears 9 are respectively engaged with racks 10 formed on the bottom faces of opposing sides of print frame 3.

A driven gear 11 is fixed to the shaft of cylinder 2 at a position adjacent one of the drive gears 9. The driven gear 11 has a smaller diameter than cylinder 2 and engage a sector gear 12. Rotation of an electric motor 13 is transmitted as a reciprocating motion to the sector gear 12 through a motion conversion mechanism comprising two rods 15. The sector gear 12 makes reciprocating rotation within a prescribed range. Reciprocal rotation of said sector gear 12 drives the cylinder 2 in a reciprocating manner through the driven gear 11. The reciprocating rotation of the cylinder 3 is transmitted to the rack 10 through the drive gear 9, and the print frame 3 makes a reciprocating motion back and forth in synchronization with the cylinder 2.

Figure 3:
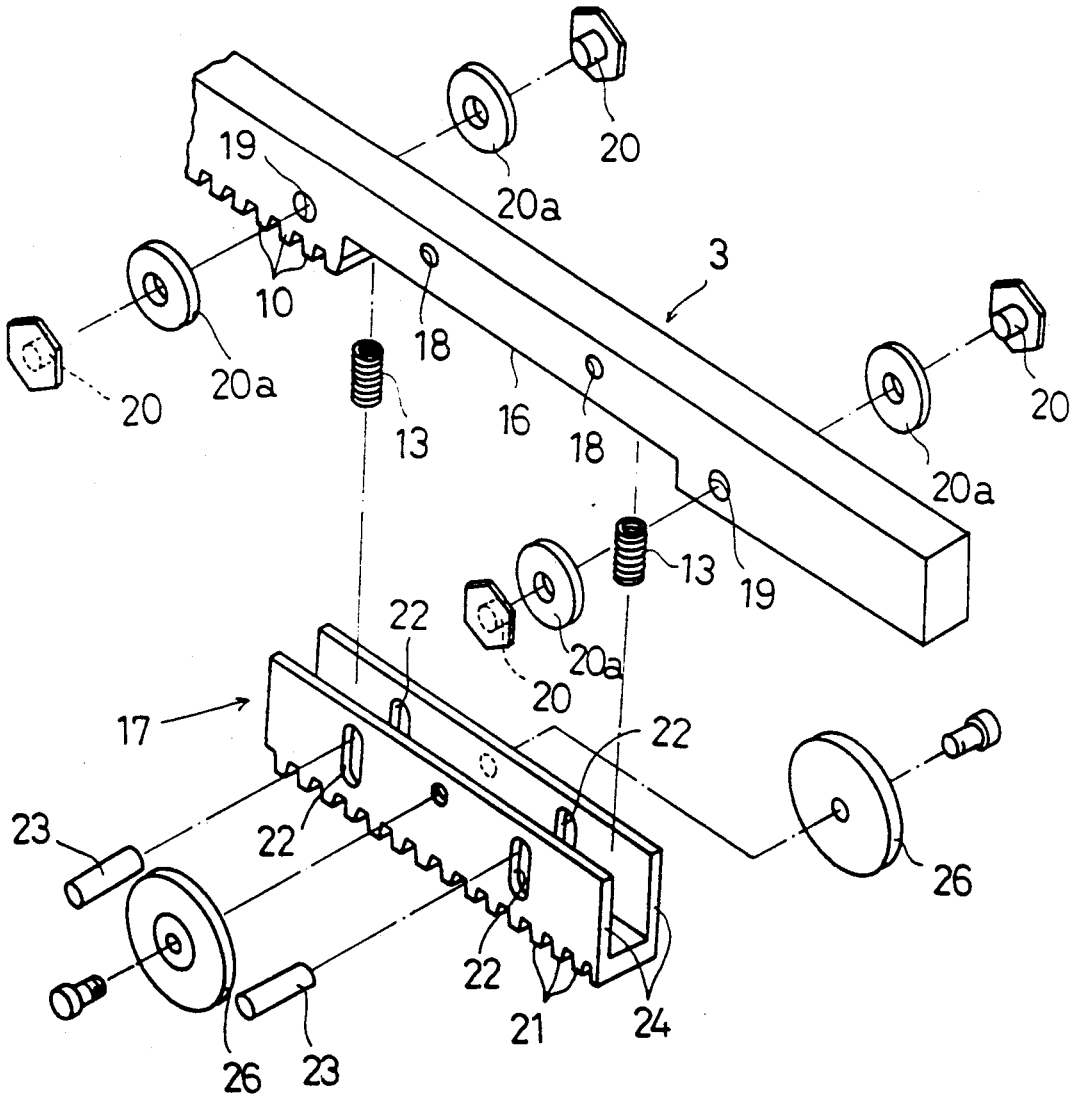
FIG. 3 is an isometric exploded view showing part of print frame.

As shown in FIG. 3, a recessed mounting portion 16 is formed in the length direction at a part of the bottom face of each side of the print frame 3. An operation piece 17 is attached to the recessed mounting portion 16. A pair of through holes 18 are made in the print frame 3 above the recessed mounting portion 16. Also a pair of supporting holes 19 are made in the print frame 3 adjacent the operation piece 17. A pair of washer-shaped guides 20*a* are supported in a rotable manner by the print frame 3 by means of shafts 20. These guides are provided at both the ends of operation piece 17.

At the bottom face of the operation piece 17, a rack 21 is formed throughout the whole length and width of the operation piece for engagement with the drive gear 9. A pair of holding walls 24 extend upward from the bottom at both sides of the operation piece 17. The operation piece 17 is attached to the print frame 3 in a manner such that the recessed mounting portion 16 can be covered by both the holding walls 24. Front and rear slots 22 are made in each holding wall 24. Pins 23 are inserted into both the slots 22 and supporting holes 18 in order to support the operation piece 17 in a vertically movable manner relative to the print frame 3. The operation piece 17 can move between an upper position (FIG. 5) and a lower position (FIG. 2). Each guide 20*a* contacts a face of the operation piece 17 and is rotated by the up-and-down motion of the operation piece 17. The guides thus insure that the operation piece can be moved up and down smoothly.

A pair of lift rollers 26 are rotatably attached to the holding walls 24. When the operation piece is at the lower position, the roller moves on the rail 25 and permits the movement of print frame 3.

A pair of front and rear compression coil springs 13 are placed between the lower face of the recessed mounting portion 16 of print frame 3 and the inner bottom face of rack 21. These springs 13 always hold the operation piece 17 at the lower position and permit the absolute engagement of small rack 21 with the drive gear 9.

Figure 5:
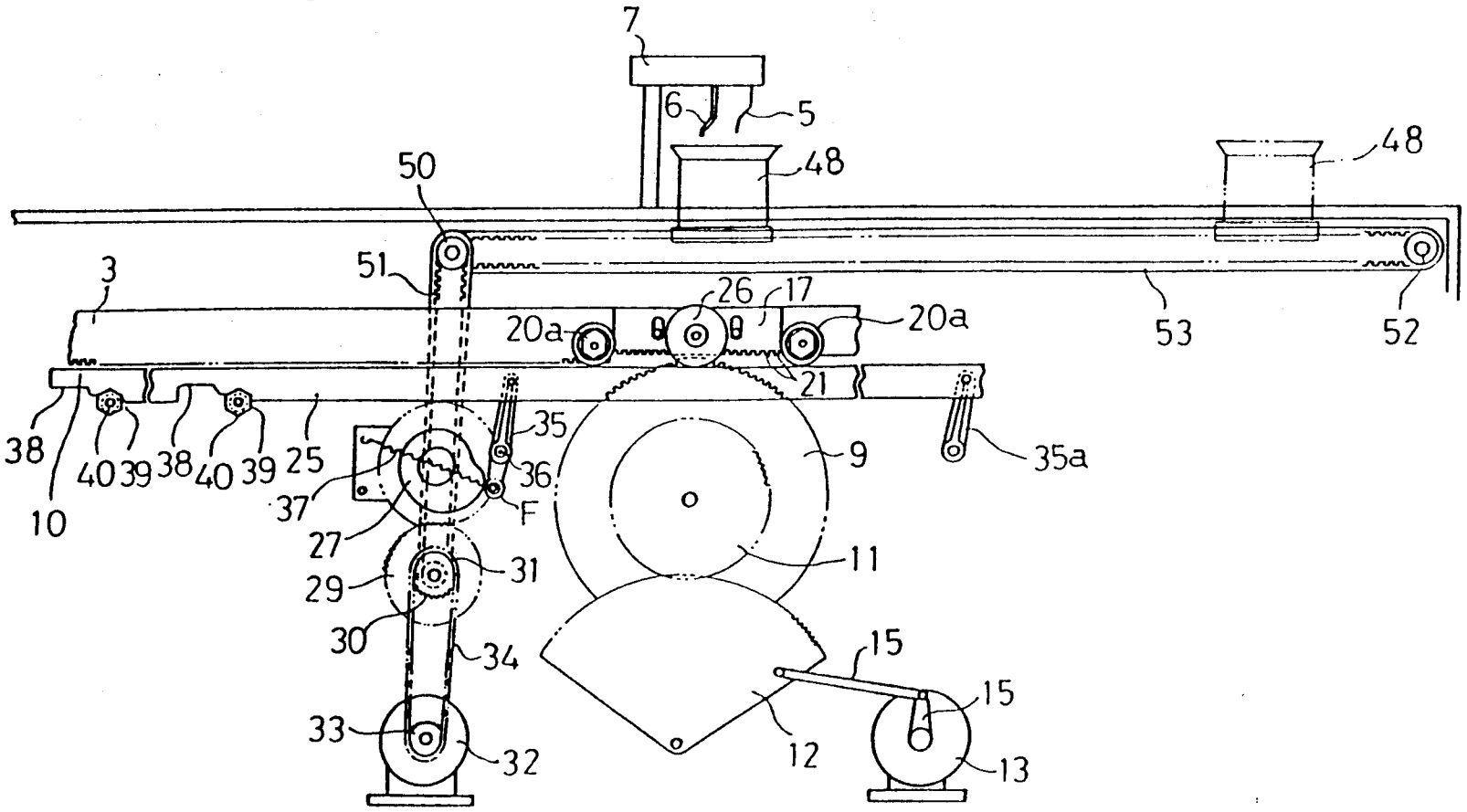
FIG. 5 is a side view showing the displacement of the ink-receiving tray during the non-printing time.
Figure 6:
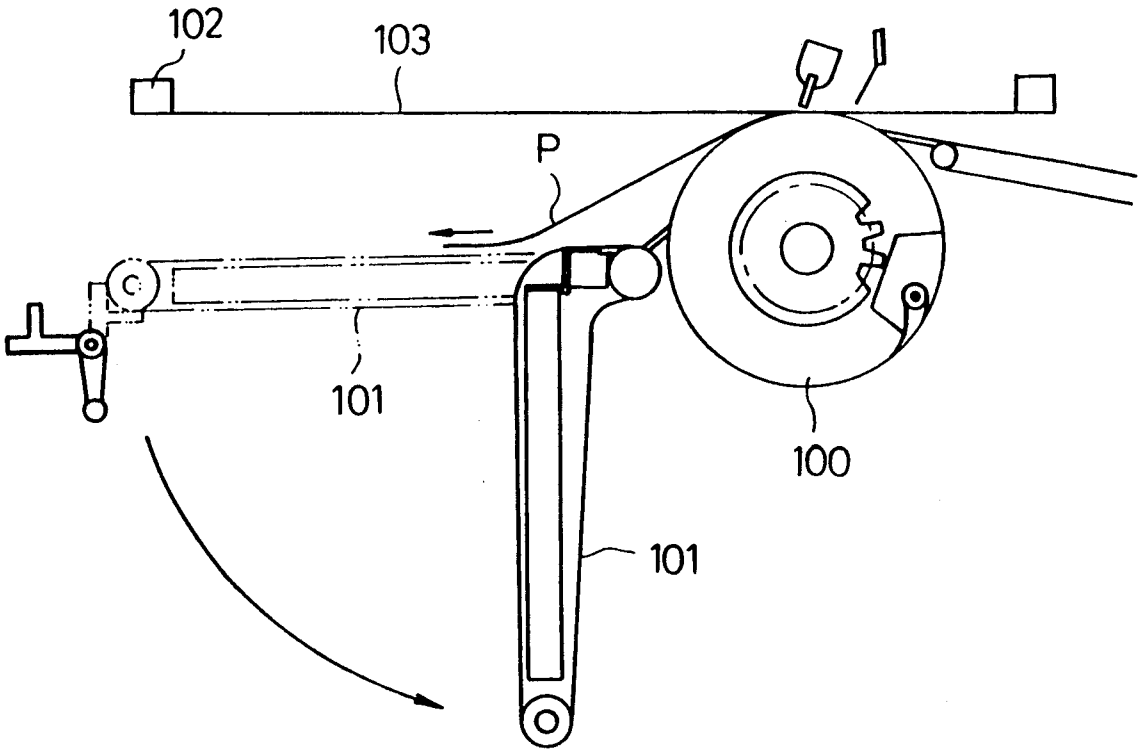
Fig. 6 (PRIOR ART)
FIG. 6 is a partially enlarged side indicating a conventional silk-screen printing machine in which the inside of the machine base can be cleaned.

As shown in FIG. 2, an electric motor 32 is installed at the paper ejecting side of the cylinder 2 in the machine base 1. A sprocket 33 is fixed to the output shaft of the motor 32. An intermediate gear 29 is supported above the motor 32 in a rotatable manner relative to the machine base 1. The intermediate gear 29 and its shaft support a sprocket 30 and a toothed pulley (FIG. 5). A chain 34 is attached between the sprockets 30 and 33. A gear 28 engages the intermediate gear 29 and is positioned above the gear 29. Gear 28 is mounted on the same shaft as a cam 27.

At the machine base 1, a drive lever 35 is rotatably supported by a support shaft 36. One end of the drive lever 35 is fixed to the rail 25 by a pin while the other end carries a rotatable cam follower F. A spring 37 biases the lever such that the cam follower F follows the movements of cam 27.

At the paper feed side of the cylinder 2, the base end portion of a supporting lever 35*a* is supported in a rotatable manner by the frame of machine base 1. The tip portion of the supporting lever 35*a* is fixed to the rail 25 by a pin.

Stepped pairs of notches 38 and 39 extend upward from the bottom face of rail 25 near the paper ejecting side of rail 25. Rotatable rail guides 40 are positioned within the notches 38, 39.

When the cam 27 is rotated by motor 32, the drive lever 35 is rotated and the rail 25 is reciprocated up and down between the upper position (FIGS. 4 and 5) and lower position (FIG. 2). Specifically, movement of the drive lever pushes the rails to the left as seen in FIG. 2, causing the paper ejecting side of the rails to rise as the rail moves from notch 38 to 39. In the lifted position, the paper feed side is held by lever 35*a*. The paper ejecting side of the rail 25 is supported by rail guides 40 which rests in notches 39. Thus, the entire rail 25 is uniformly supported at both the upper and lower positions.

When the rail 25 is moved to the upper position, the operation piece 17 is lifted by lift roller 26. This movement is against the force of spring 13. The upward movement of the operation piece 17 releases the engagement of gear 9 and rack 21. Because of this, the print frame 3 is supported by the lift rollers 26. In this state, if forces are applied to the print frame 3, the rollers 26 turn on the rail 25, thereby allowing the print frame 3 to be moved towards or away from the machine base 1.

As shown in FIG. 1, the ink-receiving tray 48 rests on the upper portion of the machine base 1. It may be moved longitudinally along the base. As shown in FIG. 5, an endless timing belt 51 extends between the pulley 31 attached to the intermediate gear 29 and a pulley 50 attached above the machine base 1. At the end portion of the feed side of the machine base 1, a pulley 52 is supported by bearings at the same height as pulley 50. A horizontal endless timing belt 53 extends between pulleys 50 and 52. The ink-receiving tray 48 is attached at the upper side of the timing belt 53.

Timing belts 51, 53 are turned by the sprockets 30, 33 which are rotated by the motor 32. Thus, the ink-receiving tray 48 is moved in synchronization with the movement of rail 25. That is, when the rail 25 is at the lower position, the ink-receiving tray 48 is held in the position indicated by the two-dot chain line in FIG. 5. At the end of printing, the motor 32 is rotated forward a predetermined amount through the operation of a manual switch (not shown). This moves the rail 25 to the upper position. At the same time, the ink-receiving tray 48 is moved to the position indicated by solid lines between the cylinder 2 and the squeegee/doctor arrangement (6,5).

The action of the silk-screen printing apparatus will be explained hereinafter. As shown in FIG. 2, the drive gear 9 is engaged with the rack 21 of the operation piece 17 during printing operations. When the motor 13 is rotated, the sector gear 12 is rotated through the rod 15, and the cylinder 2 is rotated through the driven gear 11. This rotation of cylinder 2 is transmitted to the print frame 3 through the engagement between the drive gear 9 and rack 10. Thus, the print frame 3 is moved back and forth in synchronization with the rotation of cylinder 2.

Then the cylinder 2 turns clockwise and reaches the paper feed position, a gripper (not shown) grips the printing paper. Thereafter, the cylinder 2 begins to rotate toward the paper ejecting side (counterclockwise). When the cylinder 2 reaches the printing start position, the paper it carries contacts the silk-screen 4. The squeegee 6 applies a pressure to the upper face of the silk-screen 4 and commences printing. Thereafter, when the cylinder 2 comes to the printing end position, the paper is separated from the silk-screen 4 and printing is completed. When the cylinder 2 turns further counter-clockwise and reaches the paper separating position, the gripper separates the paper from the cylinder. The printed paper is then sent to a recovering device (not shown) through the horizontally held paper ejecting plate 8, thereby completing printing.

Thereafter, the cyliner 2 is reset and returned to the paper feed position and the above operation is repeated. When all the sheets of desired sheets have been printed, the rotation of the motor 13 is stopped, and the print frame 3 is held at the position indicated in FIG. 2.

Figure 4:
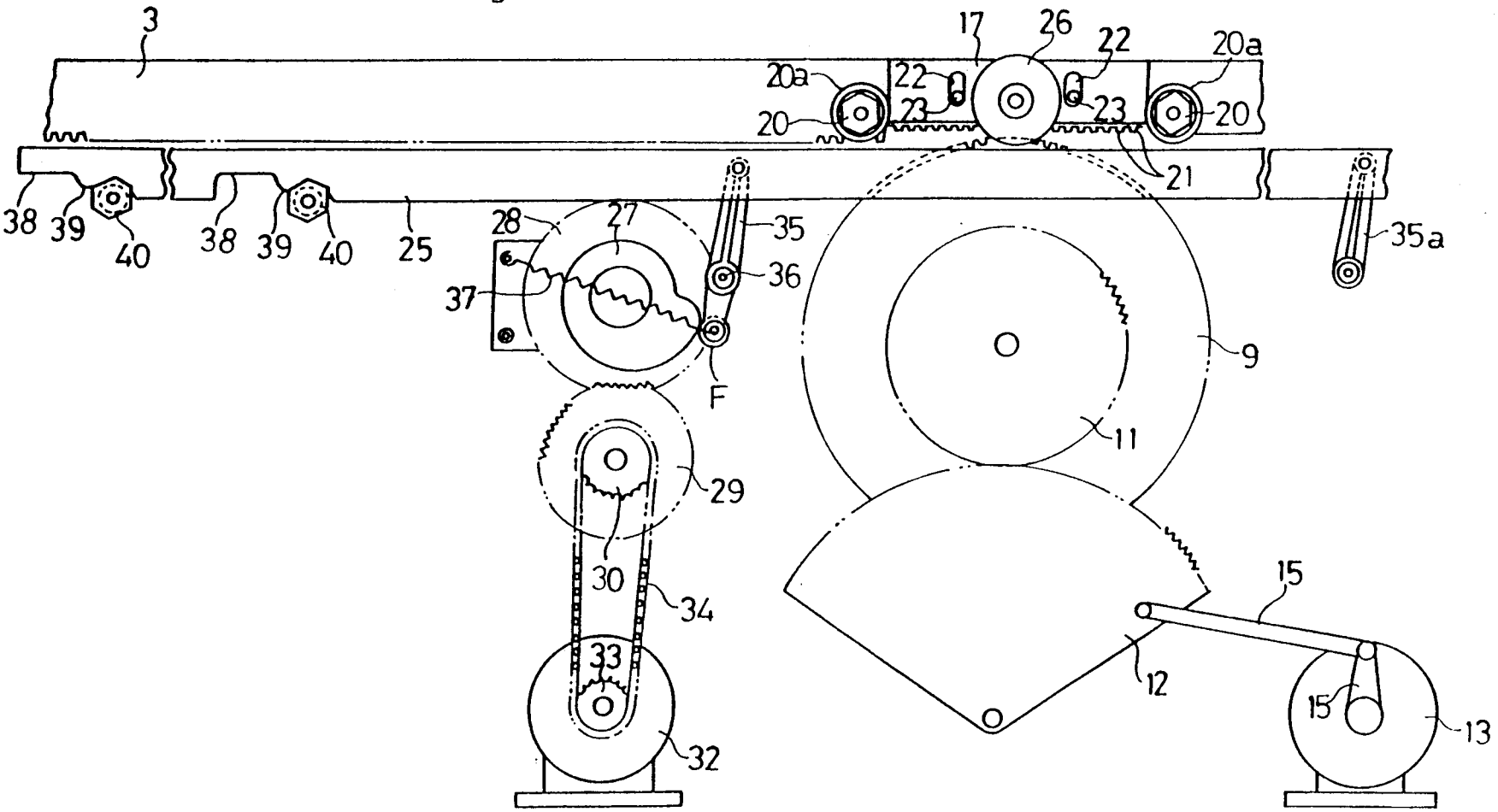
FIG. 4 is a side view showing the print frame in a pullable state during a non-printing time.

Thereafter, the motor 32 is turned and the gear 28 is rotated through the sprocket 33, chain 34, sprocket 30 and intermediate gear 29. Thus, the cam 27 is rotated clockwise as shown in FIG. 2, the rail 25 is raised by the rotation of the lever 35 counterclockwise, and an upward force will be applied to the roller 26 of the operation piece 17. Because of this, as indicated in FIG. 4, the operation piece 17 is raised by a distance determined by the difference between the diameter of pin 23 and the length of the slot 22. Additionally, the engagement between the rack 21 and drive gear 9 is released.

As said motor 32 is rotated, the belt 53 is turned by sprocket 30, pulleys 31, 50 and belt 51, and the ink-receiving tray 48 is moved to the position indicated by solid lines in FIG. 5.

Then, if the print frame 3 is pulled toward the paper ejecting side of machine base 1, then the roller 26 turns on the rail 25, so that the print frame 3 is projected out to the paper ejecting side. Then, a large space is obtained below the paper ejecting side of silk-screen 4. Therefore, in cleaning the silk-screen 4, a worker is able to clean the rear surface of the silk-screen 4 easily from the bottom side without being obstructed by the machine base 1.

When the paper ejecting plate 8 is swung into the suspended position indicated by the two-dot chain lines, a large space can be secured not only at the paper ejecting side but also as a whole below the silk-screen 4. Because of this, it becomes possible to clean the entire rear face of the silk-screen 4. Moreover the worker is able to perform the cleaning operation in a natural posture.

In addition, ink dripping from the squeegee 6 and doctor normally comes to the top face of the silk screen 4. However, at the time of cleaning said silk-screen 4, the print frame 3 is moved to the paper ejecting side and thus evacuated from the top portion of the cylinder 2. At that time, ink dripping down from the squeegee 6 and doctor 5 is recovered inside the ink-receiving tray 48 located at the position indicated by solid lines in FIG. 2, so that ink will not drip down on the periphery of cylinder 4. This prevents the cylinder from being soiled.

Moreover, the paper gripper on the periphery of the cylinder 2 can be easily checked and adjusted before printing is resumed. For this purpose, the print frame 3 should be moved to the paper ejecting side in the machine base 1 and the silk-screen 4 should be evacuated from the top of cylinder 2, and then the cylinder 2 should be kept still without being rotated.

Although only one embodiment of the present invention has been described herein, it should be apparent to those skilled in the art that the present invention may be embodied in many other specific forms without departing from the spirit or scope of the invention.

For instance, a link mechanism or the like may be used instead of the cam 27 as a lifting device for the rail 25. This alternative mechanism may be moved in synchronization with the ink-receiving tray 48. Therefore, the present embodiment is to be considered as illustrative and the invention is not to be limited to the details given herein, but may be modified within the scope of the appended claims.

What is claimed is:

1. In a cylinder type silk-screen printing apparatus that performs a printing operation by moving a silk-screen print in synchronization with the rotation of a cylinder located inside a machine base, the printing apparatus comprising:

a print frame located above said cylinder for carrying said silk-screen print;

linking means for linking the print frame with said cylinder during printing;

reciprocating means for reciprocating said print frame in a horizontal direction in synchronization with the rotation of said cylinder;

a releasing means operable during non-printing times for releasing the linkage between said print frame and said cylinder to thereby permit the movement of said print frame independently from the rotation of said cylinder;

pressing means for pressing printing paper against the cylinder; and an ink-receiving tray capable of moving in synchronization with the releasing means between a position separated from said cylinder to a position facing said cylinder for collecting drippings from said pressing means.

2. A cylinder type silk-screening printing apparatus as recited in claim 1 wherein said pressing means includes:

a squeegee and a doctor for holding the printing paper on the cylinder.

3. A cylinder type silk-screen printing apparatus as recited in claim 1 wherein:

said cylinder carries a gear having a diameter almost equal to the diameter of said cylinder, and said print frame includes a first rack that engages said gear during printing, said rack being disposed on a bottom face of said print frame.

4. A cylinder type silk-screen printing apparatus as set forth in claim 3, wherein said print frame further includes an operation piece movable between upward and downward positions, the operation piece including a second rack having a pitch which is the same as a pitch of said frist rack, said second rack being biased towards a level continuous with said first rack and engaged with said gear.

5. A cylinder type silk-screen printing apparatus as set forth in claim 4, wherein said releasing means comprises:

vertically movable rails that extend parallel with and below said print frame;

contacting members attached to said operation piece and extending downward into contact with said rails; and displacing members for vertically displacing said rails and then vertically displacing said operation piece through said contacting members.

6. A cylinder type silk-screen printing apparatus as recited in claim 5, wherein said contacting members include rollers attached to said operation piece in a rotatable manner.

7. A cylinder type silk-screen printing apparatus as recited in claim 5, wherein said displacing members include a cam mechanism.

8. A cylinder type silk-screen printing apparatus as recited in claim 7, wherein said operation piece is mounted to said print frame with columnar pins inserted into vertically extending slots in said operation piece.

9. A cylinder type silk-screen printing apparatus as recited in claim 7, wherein said cam mechanism includes an eccentric cam member, means for rotating the cam member, and a cam follower that follows the periphery of said eccentric cam; said rails being vertically displaced based on the profile of said eccentric cam.

10. A cylinder type silk-screen printing apparatus as recited in claim 7 further comprising an ink-receiving tray movable in synchronization with said cam mechanism between a position separated from said cylinder to a position facing said cylinder for collecting drippings from said squeegee and said doctor.

11. A cylinder type silk-screen printing apparatus as recited in claim 10, wherein said driving means includes a motor having a rotatable shaft for rotating an eccentric cam member, the printing apparatus further comprising a sprocket carried by the shaft for rotating therewith, said ink-receiving tray being moved by a belt driven by said sprocket.

12. A cylinder type silk-screen printing apparatus as set forth in claim 1, wherein said machine base includes a paper ejecting base that is rotatable between a horizontal position and a suspended position.

13. In a cylinder type-screen printing apparatus that performs a printing operation by moving a silk-screen print in synchronization with the rotation of a cylinder located inside a machine base, the printing apparatus comprising:

a squeegee and a doctor for holding paper on the cylinder;

a print frame for carrying said cylinder;

linking means for linking said print frame with said cylinder during printing;

reciprocating means for reciprocating said print frame in a horizontal direction in synchronization with the rotation of said cylinder;

a releasing means operable during non-printing times for releasing the linkage between said print frame and said cylinder to permit the movement of said print frame independent from rotation of said cylinder; and an ink-receiving tray capable of moving in synchronization with the releasing means between a position separated from said cylinder to a position facing said cylinder for collecting drippings from said squeegee and said doctor.

14. A cylinder type silk-screen printing apparatus as recited in claim 13, wherein:

said cylinder carries a gear having a diameter larger than that of said cylinder;

said print frame includes a first rack disposed on a bottom face of the print frame for engaging the gear during printing operations;

the printing apparatus further includes an operation piece coupled to the print frame in a vertically displaceable manner, the operation piece including a second rack having a pitch which is the same as a pitch of said first rack; and said second rack is normally biased towards a level continuous with the first rack and being engaged with said gear.

15. A cylinder type silk-screen printing apparatus as recited in claim 13, wherein said releasing means includes:

vertically movable rails that extend parallel with and below said print frame;

contacting members attached to said operation piece and extending downward into contact with said rails; and displacing members for vertically displacing said rails and vertically displacing said operation piece through said contacting members.

16. A cylinder type silk-screen printing apparatus as recited in claim 15, wherein:

said displacing members include a cam mechanism for pushing said rail upward and pressing said operation piece upward through said contacting member in order to disengage said second rack from said gear; and said operation piece is attached to said print frame with columnar pins that extend vertically through slots in said operation piece.

17. A cylinder type silk-screen printing apparatus as recited in claim 15, wherein said contacting members are rollers mounted in a rotatable manner to said operation piece.

18. A cylinder type silk-screen printing apparatus as recited in claim 13, wherein said ink-receiving tray is moved in synchronization with a cam drive mechanism.

19. A cylinder type silk-screen printing apparatus as recited in claim 13, wherein said machine base is attached to a paper ejecting base in a swingable manner between a horizontal position and a suspended position.

20. In a cylinder type silk-screen printing apparatus that performs a printing operation by moving a silk-screen print in synchronization with the rotation of a cylinder located inside a machine base, the improvement comprising:

a squeegee and a doctor for holding paper on the cylinder;

a gear carried by the cylinder for rotation therewith, said gear having a diameter larger than that of said cylinder;

a print frame for carrying said cylinder, the print frame being linked with said cylinder during printing and being reciprocable in a horizontal direction in synchronization with the rotation of said cylinder, said print frame including a first rack disposed on a bottom face of the print frame for engaging the gear during printing operations;

an operation piece coupled to the print frame in a vertically displaceable manner, the operation piece including a second rack having a pitch which is the same as a pitch of said first rack, the second rack being biased towards a level continuous with the first rack and being engaged with said gear;

vertically movable rails that extend parallel with and below said print frame;

a plurality of rollers rotatably attached to said operation piece for contacting said rails;

an eccentric cam for pushing said rails upward and pressing said operation piece upward through said rollers in order to disengage said second rack from said gear; and a paper ejecting base installed in a swingable manner below said print frame for movement between a horizontal position for receiving paper ejected from said cylinder and a suspending position.

21. In a cylinder type silk-screen printing apparatus that performs a printing operation by moving a silk-screen print in synchronization with the rotation of a cylinder located inside a machine base, the printing apparatus comprising:

a print frame located above said cylinder for carrying said silk-screen print;

linking means for linking the print frame with said cylinder during printing;

reciprocating means for reciprocating said print frame in a horizontal direction in synchronization with the rotation of said cylinder;

a releasing means operable during non-printing times for releasing the linkage between said print frame and said cylinder to thereby permit the movement of said print frame independently from the rotation of said cylinder;

pressing means for pressing printing paper against the cylinder; and an ink-receiving tray capable of moving in synchronization with the releasing means between a position separated from said cylinder to a position facing said cylinder for collecting drippings from said pressing means; wherein:

said cylinder carries a gear having a diameter almost equal to the diameter of said cylinder;

said print frame includes a first rack that engages said gear during printing, said rack being disposed on a bottom face of said print frame; and said print frame further includes an operation piece movable between upward and downward positions, the operation piece including a second rack having a pitch which is the same as a pitch of said first rack, said second rack being biased towards a level continuous with said first rack and engaged with said gear.

* * * * *